US009511603B2

(12) United States Patent
Piatt et al.

(10) Patent No.: US 9,511,603 B2
(45) Date of Patent: Dec. 6, 2016

(54) METHOD FOR PRINTING IMAGE PLANES ON SUBSTRATE

(71) Applicants: Michael J. Piatt, Dayton, OH (US); Eric Karl Zeise, Pittsford, NY (US)

(72) Inventors: Michael J. Piatt, Dayton, OH (US); Eric Karl Zeise, Pittsford, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/501,861

(22) Filed: Sep. 30, 2014

(65) Prior Publication Data

US 2016/0089881 A1 Mar. 31, 2016

(51) Int. Cl.

| | |
|---|---|
| ***B41J 11/00*** | (2006.01) |
| ***B41J 11/42*** | (2006.01) |
| ***B41J 11/46*** | (2006.01) |
| ***B41J 3/54*** | (2006.01) |

(52) U.S. Cl.
CPC . *B41J 11/42* (2013.01); *B41J 3/54* (2013.01); *B41J 11/0095* (2013.01); *B41J 11/46* (2013.01)

(58) Field of Classification Search
CPC ..... B41J 11/0095; B41J 11/46; B41J 11/42
USPC ..... 347/4, 19, 101, 105
See application file for complete search history.

(56) References Cited

U.S. PATENT DOCUMENTS

| | | | | |
|---|---|---|---|---|
| 4,485,982 | A * | 12/1984 | St. John et al. | 242/563.1 |
| 6,068,362 | A * | 5/2000 | Dunand | B41J 3/4078 347/104 |
| 2003/0234959 | A1* | 12/2003 | Goldberg | 358/1.18 |
| 2011/0074860 | A1* | 3/2011 | Saettel | B41J 2/175 347/19 |

* cited by examiner

*Primary Examiner* — Jason Uhlenhake
(74) *Attorney, Agent, or Firm* — Peyton C. Watkins; William R. Zimmerli

(57) ABSTRACT

A method for printing a plurality of image planes on a substrate, the method includes providing a plurality of print head for depositing material on the substrate as the substrate moves along a transport path; providing a first sensor in a predetermined position along a transport path relative to predetermined positions of the plurality of print heads; providing an indication of position of the substrate along the transport path; providing a plurality of cue marks at predetermined positions or intervals on the substrate which are detected by the first sensor; and determining placement of an image plane printed by at least one of the plurality of print heads upstream of the first sensor based on the detection of position of the cue marks on the substrate by the first sensor.

13 Claims, 8 Drawing Sheets

METHOD FOR PRINTING IMAGE PLANES ON SUBSTRATE

FIELD OF THE INVENTION

The present invention generally relates to inkjet printing systems and more particularly to performing color-to-color registration correction in an inkjet printing system.

BACKGROUND OF THE INVENTION

In a digitally controlled printing system, a print medium is directed through a series of components. The print medium can be cut sheet or a continuous web. As the print medium moves through the printing system, liquid, for example, ink, is applied to the print medium by one or more lineheads. This is commonly referred to as jetting of the ink.

In commercial inkjet printing systems, the print medium is physically transported through the printing system at a high rate of speed. For example, the print medium can travel 650 to 1000 feet per minute. The lineheads in commercial inkjet printing systems typically include multiple printheads that jet ink onto the print medium as the print medium is being physically moved through the printing system. A reservoir containing ink or some other material is usually behind each nozzle plate in a linehead. The ink streams through the nozzles in the nozzle plates when the reservoirs are pressurized.

The printheads in each linehead in commercial printing systems typically jet only one color. Thus, there is a linehead for each colored ink when different colored inks are used to print content. For example, there are four lineheads in printing systems using cyan, magenta, yellow and black colored inks. The content is printed by jetting the colored inks sequentially, and each colored ink deposited on the print medium is known as a color plane. The color planes need to be aligned, or registered with each other so that the overlapping ink colors produce a quality single image.

Color registration errors can be partitioned into different types. Examples of color registration errors include, but are not limited to, a color plane having a linear translation with respect to another color plane, a color plane being rotated with respect to another color plane, and a color plane being stretched, contracted, or both stretched and contracted in different regions or in different directions with respect to another color plane.

There are several variables that contribute to the registration errors in color plane alignment including physical properties of the print medium, conveyance of print medium, ink application system, ink coverage, and drying of ink. Color registration errors are typically managed by controlling these variables. However, controlling these variables can often restrict the range of desired print applications. For example, color plane to color plane registration errors will typically become larger than desired as paper weight for the print application is reduced, when ink coverage is increased, or when the amount of ink coverage becomes more variable between printed documents. These limitations compromise the range of suitable applications for ink jet printing systems.

SUMMARY OF THE INVENTION

The present invention is directed to overcoming one or more of the problems set forth above. Briefly summarized, according to one aspect of the invention, the invention resides in a method for printing a plurality of image planes on a substrate, the method comprises providing a plurality of print head for depositing material on the substrate as the substrate moves along a transport path; providing a first sensor in a predetermined position along a transport path relative to predetermined positions of the plurality of print heads; providing an indication of position of the substrate along the transport path; providing a plurality of cue marks at predetermined positions or intervals on the substrate which are detected by the first sensor; determining placement of an image plane printed by at least one of the plurality of print heads upstream of the first sensor based on the detection of position of the cue marks on the substrate by the first sensor.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

Embodiments of the invention are better understood with reference to the following drawings. The elements of the drawings are not necessarily to scale relative to each other.

DETAILED DESCRIPTION OF THE INVENTION

Figure 1:
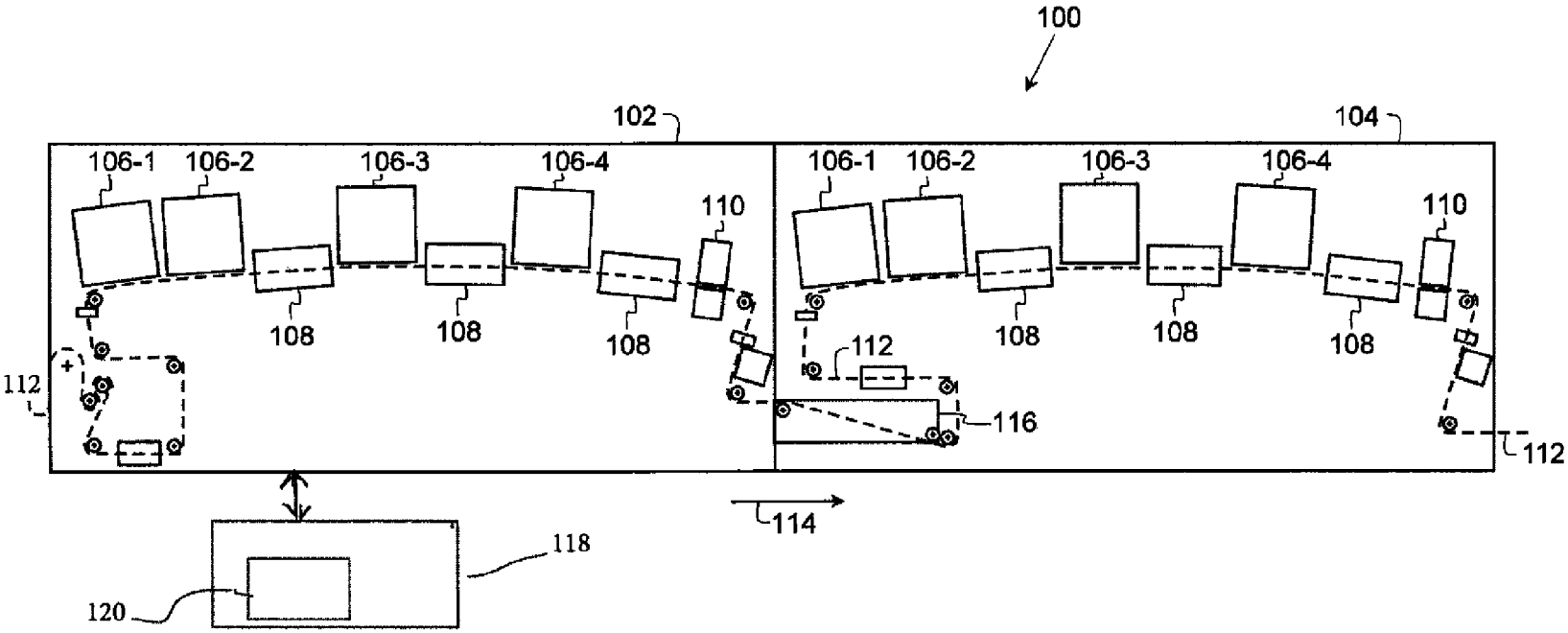
FIG. 1 is a schematic of a continuous web inkjet printing system.

Throughout the specification and claims, the following terms take the meanings explicitly associated herein, unless the context clearly dictates otherwise. Additionally, directional terms such as "on", "over", "top", "bottom", "left", "right" are used with reference to the orientation of the Figure(s) being described. Because components of aspects of the present invention can be positioned in a number of different orientations, the directional terminology is used for purposes of illustration only and is in no way limiting.

The present description will be directed in particular to elements forming part of, or cooperating more directly with, a system in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

As described herein, the example aspects of the present invention are applied to color plane registration in inkjet printing systems. However, many other applications are emerging which use inkjet printheads or similar nozzle arrays to emit fluids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. In addition, a nozzle array can jet out gaseous material or other fluids. As such, as described herein, the terms "liquid", "ink" and "inkjet" refer to any material that is ejected by a nozzle array. For simplicity and clarity of description, the invention will be described in terms of a multi-color printer. It must be understood that the invention similarly applies to other applications such as the printing of multiple layers of an electronic circuit where the individual circuit layers would correspond to an image plane in the color printer. In such applications, registration of the individual layers must be maintained for proper operation of the electronic circuit in a similar manner to the registration of the color image planes in the color prints. It is anticipated that many other applications may be developed in which the invention may be employed to enhance the registration of the image planes.

Inkjet printing is commonly used for printing on paper. However, printing can occur on any substrate or receiving medium. For example, vinyl sheets, plastic sheets, glass plates, textiles, paperboard, and corrugated cardboard can comprise the print medium. Additionally, although the term inkjet is often used to describe the printing process, the term jetting is also appropriate wherever ink or other fluid is applied in a consistent, metered fashion, particularly if the desired result is a thin layer or coating.

Inkjet printing is a non-contact application of an ink to a print medium. Typically, one of two types of ink jetting mechanisms are used and are categorized by technology as either drop on demand ink jet (DOD) or continuous ink jet (CIJ). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting drops so that print drops reach the print medium and non-print drops are caught by a collection mechanism. Various approaches for selectively deflecting drops have been developed including electrostatic deflection, air deflection, and thermal deflection.

Additionally, there are typically two types of print medium used with inkjet printing systems. The first type is commonly referred to as a continuous web while the second type is commonly referred to as cut sheet(s). The continuous web of print medium refers to a continuous strip of print medium, generally originating from a source roll. The continuous web of print medium is moved relative to the inkjet printing system components via a web transport system, which typically includes drive rollers, web guide rollers, and web tension sensors. Cut sheets refer to individual sheets of print medium that are moved relative to the inkjet printing system components via a support mechanism (e.g., rollers and drive wheels or a conveyor belt system) that is routed through the inkjet printing system.

The present invention described herein is applicable to both types of printing technologies. As such, the terms linehead and printhead, as used herein, are intended to be generic and not specific to either technology. Additionally, the present invention described herein is applicable to both types of print medium. As such, the terms print medium and web, as used herein, are intended to be generic and not as specific to one type of print medium or web or the way in which the print medium or web is moved through the printing system. Additionally, the terms linehead, printhead, print medium, and web can be applied to other nontraditional inkjet applications, such as printing conductors on plastic sheets.

The terms "color plane" and "image plane" are used generically and interchangeably herein to refer to a portion of the data that is used to specify the location of features that are made by a particular station of a digitally controlled printing system on the print medium. Similarly, "color-to-color registration" is used generically herein to refer to the registration of such features that are made by different stations on the print medium. For color printing of images, the patterns of dots printed by different printheads in printing the same or different colors must be registered with each other to provide a high quality image. An example of a non-color printing application is functional printing of a circuit. The patterns of dots printed by different printheads, the image planes, form directly or serve as catalysts or masks for the formation of different layers of deposited conductive materials, semiconductor materials, resistive materials, insulating materials of various dielectric constants, high permeability magnetic materials, or other types of materials, must also be registered to provide a properly functioning circuit. The terms color plane and color-to-color registration can also be used herein to refer to the mapping and registration of pre-print or finishing operations, such as the mapping of where the folds or cutting or slitting lines are, or the placement of vias in an electrical circuit.

The terms "upstream" and "downstream" are terms of art referring to relative positions along the transport path of the print medium; the print media moves along the transport path move from upstream to downstream. In FIGS. 1-5, and 7 the print medium moves in a direction indicated by transport direction arrow 114. Where they are used, terms such as "first", "second", and so on, do not necessarily denote any ordinal or priority relation, but are simply used to more clearly distinguish one element from another.

The schematic side view of FIG. 1 shows one example of a continuous web inkjet printing system. Printing system 100 includes a first tower 102 and a second tower 104, each of which includes lineheads 106, dryers 108, and a quality control sensor 110. Each linehead 106 typically includes multiple printheads (not shown) that apply ink or another fluid (gas or liquid) to the surface of the print medium 112 that is adjacent to the printheads. For descriptive purposes only, the lineheads 106 are labeled a first linehead 106-1, a second linehead 106-2, a third linehead 106-3, and a fourth linehead 106-4. In the illustrated aspect, each linehead 106-1, 106-2, 106-3 and 106-4 applies a different colored ink to the surface of the print medium 112 that is adjacent to the lineheads. By way of example only, linehead 106-1 applies cyan colored ink, linehead 106-2 magenta colored ink, linehead 106-3 yellow colored ink, and linehead 106-4 black colored ink.

The first tower 102 and the second tower 104 also include a web tension system that serves to physically move the print medium 112 through the printing system 100 in the transport direction 114 (left to right as shown in the figure). The print medium 112 enters the first tower 102 from a source roll (not shown) and the linehead(s) 106 of the first tower applies ink to one side of the print medium 112. As the print medium 112 feeds into the second tower 104, a turnover module 116 is adapted to invert or turn over the print medium 112 so that the linehead(s) 106 of the second tower 104 can apply ink to the other side of the print medium 112. The print medium 112 then exits the second tower 104 and is collected by a print medium receiving unit (not shown).

Processor 118 can be connected to various components in the web tension system and used to control the positions of the components, such as gimbaled or caster rollers. Processor 118 can be connected to the quality control sensor 110 and used to process images or data received from the sensor 110. Processor 118 can be connected to components in printing system 100 using any known wired or wireless communication connection. Processor 118 can be a separate from printing system 100 or integrated within printing system 100 or within a component in printing system 100. Processor 118 can be a single processor or one or more processors. Each of the one or more processors can be separate from the printing system or integrated within the printing system.

One or more storage devices 120 are connected to the processor 118. The storage device 120 can store color plane correction values in an aspect of the invention. The storage device 120 can be implemented as one or more external storage devices; one or more storage devices included within the processor 118; or a combination thereof. The storage device can include its own processor and can have memory accessible by the one or more processors 118.

Figure 2:
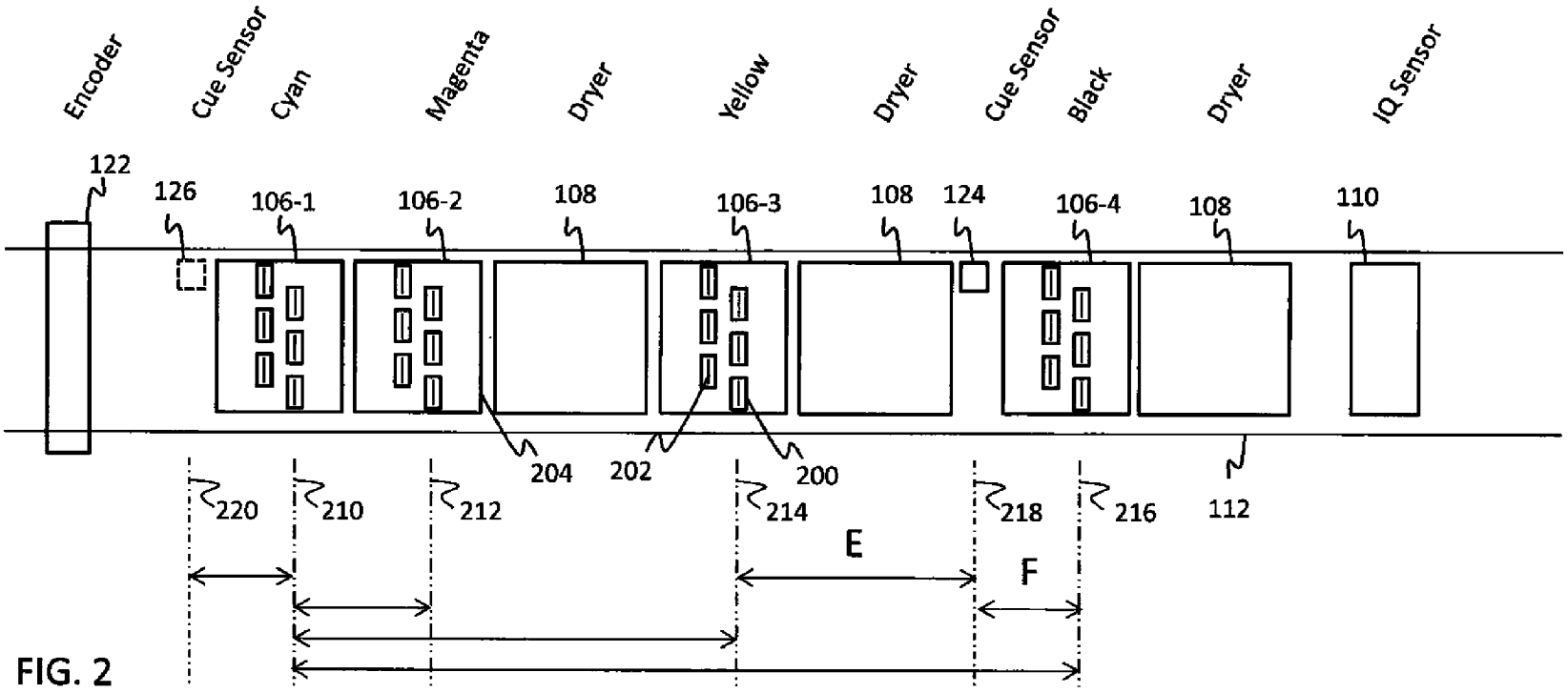
FIG. 2 is a schematic of a portion of printing system 100 in more detail.

FIG. 2 illustrates a portion of printing system 100 in more detail. As the print medium 112 is moved through printing system 100, the lineheads 106, which typically include a plurality of printheads 200, apply ink or another fluid onto the print medium 112 via the nozzle arrays 202 of the printheads 200. The printheads 200 within each linehead 106 are located and aligned by a support structure 204 in the illustrated aspect. After the ink is jetted onto the print medium 112, the print medium 112 passes beneath the one or more dryers 108 which apply heat or air to the ink on the print medium. The operation of the lineheads is controlled by the controller 118 (FIG. 1) which receives signals related to the passage of the print media along the transport path from encoder 122 and from one or more cue sensors 124 and 126. FIG. 2 also includes references lines adjacent to the transport path of the print media. Reference lines 210, 212, 214, and 216 correspond to the locations along the transport path at which the lineheads 106-1, 106-2, 106-3, and 106-4 complete the printing of the first, second, third, and fourth image planes, respectively, and reference lines 218 and 220 correspond to the locations along the transport at which cue marks are detected by the cue sensors 124 and 126, respectively.

Figure 3:
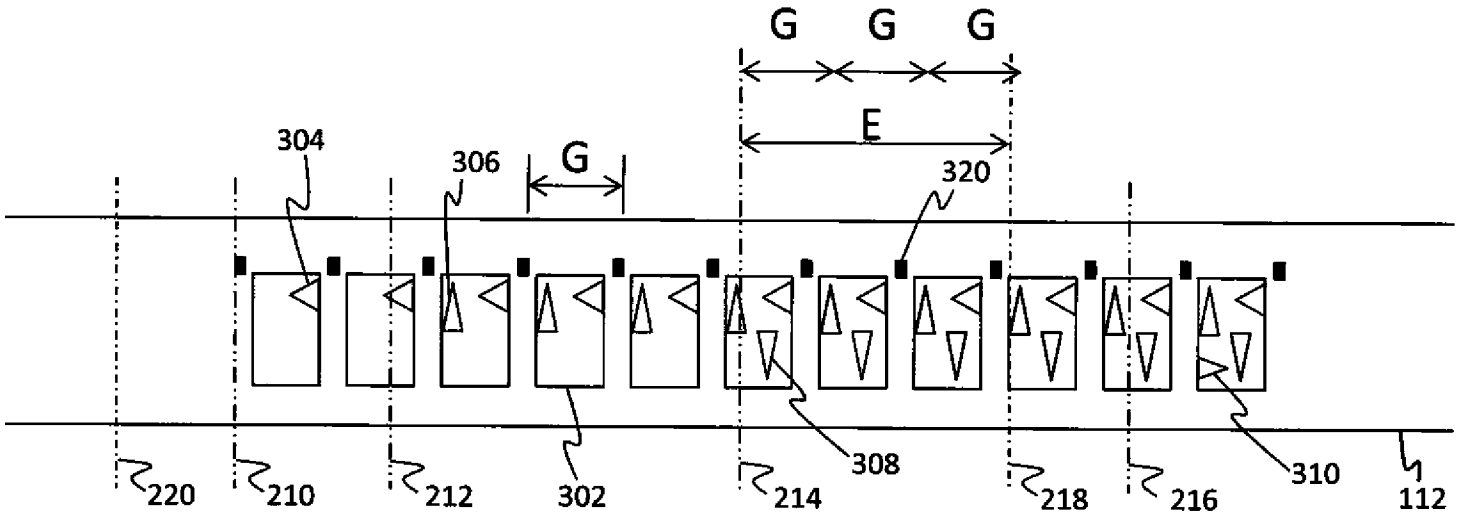
FIG. 3 illustrates a print job including a number of documents according to an aspect of the invention.

FIG. 3 shows the sequential nature of the printing of the image planes on the print media 112 as it moves along the transport path. As the print media 112 passes reference line 210, which corresponds to the position of the first linehead 106-1 (FIG. 2), the first image plane 304 is printed on the print media. As the print media 112 passes reference line 212, which corresponds to the position of the second linehead 106-2 (FIG. 2), the second image plane 306 is printed on the print media. The third image plane 308 is printed on the print media as it passes the third linehead, corresponding to reference line 214. The fourth image plane 310 is printed on the print media as it passes the fourth linehead, corresponding to the location of reference line 216.

As the print media moves along the transport path its position is monitored to enable the controller 118 (FIG. 1), also known as a processor, to control the operation of the lineheads so that the image planes can be properly registered. An encoder 122 (FIG. 2) is commonly used to monitor and provide an indication of the position of the print media as it passes along the transport path. The encoder often is a rotary encoder attached to a roller over which the print media rolls. Such rotary encoders produce a defined number of electronic pulses per revolution of the encoder. Through the appropriate selection of the attached roller diameter, such rotary encoders produce an integer number of encoder pulses per print pixel spacing. Alternative encoders include optical encoders that direct light at the print media and then detect the motion of the print media through such means at image correlation of captured images or by detection of Doppler shifted light scattered from the print media. With appropriate processing, these optical encoders also output a defined number of pulses per unit length of print media travel. A counting of encoder pulses as the print media moves through the printing module enables the processor 118 (FIG. 1) to track the motion of the print media as it passes along the transport path past the lineheads. It has been common therefore to delay the print for the various lineheads 106-2 to 106-4 relative to a most upstream linehead 106-1 by the number of encoder pulses that corresponds to the transport path spacing between the upstream linehead 106-1 and the downstream lineheads. For example, if the second linehead 106-2 is spaced 15 inches downstream of the first linehead, and the encoder produces 1000 pulses per inch of travel, then a 15,000 encoder pulse delay would be applied to the printing of the second linehead relative to the first linehead relative to the print from the first linehead.

When the print job is printed, the print medium can receive varying amounts of ink during printing. In turn, the aqueous component of the ink is absorbed into the print medium and can cause the print medium to swell and stretch, especially with water-based ink having high ink laydown regions of the printed content and if the print medium is under tension. Stretch can be higher in the direction of movement (i.e., the in-track or transport direction) than in the cross-track direction. Ink dryers along the transport path remove moisture from the print medium causing the print medium to shrink. When the print medium is heated in between lineheads, regions of the print medium can be stretched and shrunk one or more times as the print medium moves through the printing system. When the print medium undergoes stretch or shrinkage, the number of encoder pulses required for a point on the print medium to move from lineheads 106-1 to one of the downstream lineheads can deviate from normal. This can the image planes printed by the lineheads 106-2 to 106-4 to be misregistered relative to the image plane printhead by the linehead 106-1.

Printing with several color planes in which each color record is printed sequentially requires color laydown registration. Unanticipated or unaccounted for stretch or shrink in the print medium can produce a loss of color registration and can lead to blurry content or hue degradation. Additionally, printing on both sides of the print medium usually requires front-to-back registration, and the second side of the print medium is usually printed significantly later than the first side.

Figure 4:
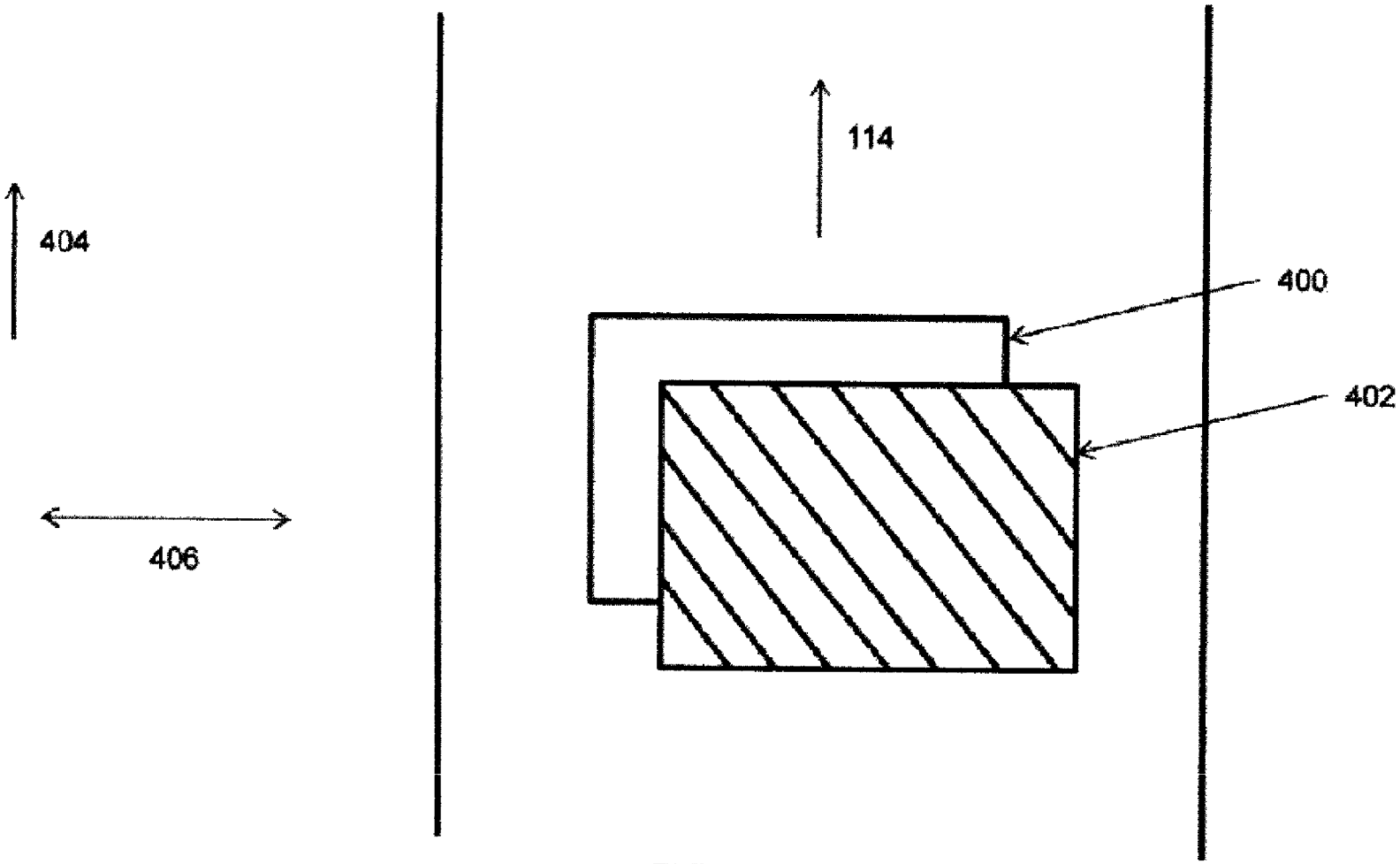
FIG. 4 illustrates one example of a color registration error produced by the translation of one color plane relative to another color plane.

FIG. 4 depicts one example of cross-track and in-track color registration errors produced by the translation of a color plane relative to another color plane. Relative translation is one type of color registration error. Typically, one color plane is used as a reference color plane 400. By way of example only, the reference color plane can be black. Errors in registration for the remaining color planes can be determined by comparing each color plane to the reference color plane. Color plane 402 is shifted or translated with respect to the reference color plane 400. Color plane 402 has color registration errors in both the in-track direction 404 and the cross-track direction 406 in the illustrated aspect.

As mentioned earlier, the print media can change dimensionally when ink is applied to it. In high speed inkjet printers, the spacing of the lineheads along the transport path can become quite large, such a distance of 3.6 meters between the first linehead and the fourth linehead in the Kodak Prosper 6000 printer. With such a distance, even a small fractional change in print media length can result in registration shifts of many pixels between the image planes printed by the first and the last lineheads.

To overcome this problem, some prior art systems time the printing of documents by a linehead from the detection of a cue mark printed on the print media by a cue sensor associated with and located upstream from the printhead, such as controlling the print timing of linehead 106-4 relative to the detection of a cue mark 320 on the print medium 112 by cue sensor 124. Linehead 106-4 begins the printing of image plane 310 of a document 302 at an appropriate cue delay (measured in number of encoder pulses) from the cue pulse signaling the detection of a cue mark by the cue sensor 124. As the cue delay depends in part on the distance between the cue sensor and the associated linehead. As this distance is much smaller than the distance between the first and the last linehead 106-1 and 106-4 respectively, this process is much less sensitive to in-track dimensional changes of the print media than systems that base the control the print timing of the linehead 106-4 relative print time of the most upstream linehead 106-1. Individual cue sensors can be positioned along the transport path upstream of each of lineheads 106-2 and 106-3 and used for the timing of the print by those lineheads. Such prior art systems have a cue sensor associated with each linehead after the first linehead. It has been found however that while such print control systems can reduce the color to color registration errors produced by the in-track stretching and shrinking of the print media, that registration errors can occur due to inconsistent detection of the leading edge of the cue mark by the various cue sensors. The number of cue sensors in such systems also adds cost to the printing system.

In some of these prior art systems, the cue marks are printed by the first, or most upstream linehead 106-1. In such systems the first linehead doesn't have an associated cue sensor, but rather the image plane 304 printed by the first linehead are printed after an appropriate cue delay from the onset of printing of the cue mark 320 by the linehead. The onset of printing of a cue mark by the first linehead therefore serves as a cue signal for the first linehead. Typically the time between the printing of consecutive cue marks is measured in terms of encoder pulses as is determined by the length of the documents to be printed.

The present invention uses a single cue sensor 124 for the control of not only an associated downstream linehead 106-1 but also for an associated upstream linehead 106-3. By so doing, it eliminates the need for an additional cue sensor and the variability associated with detection of the cue marks by an additional cue sensor. The control of the linehead 106-4 downstream of the cue sensor 124 uses a cue delay appropriate for the distance F between the cue sensor 124 and the linehead 106-4. Linehead 106-3 being located upstream of the cue sensor by a distance E, would seem to require a cue delay with a negative value. But negative cue delays don't make sense, one can't start printing an image plane for a document some number of encoder pulses ahead of detecting the cue mark that is used to initiate the counting of encoder pulses. However the cue marks are printed at known spacings or intervals on the substrate. Instead of initiating the printing of image plane 308 of a given document 302 after detecting of a cue mark that immediately precedes the given document on the print medium, the printing of image plane 308 of the document is initiated following the detection of a different cue mark that is located one or more cue mark spacings G farther downstream of the document than the cue mark that immediately precedes the document. If the spacing between cue marks is a distance G, and the spacing between the linehead 106-3 and the cue sensor 124 is a distance E, then the detection of the Nth cue mark downstream of the document is used to initiate the printing of the document; where N is 2 plus the integer part of E/G, $$N = 2 + INT\left(\frac{E}{G}\right).$$

In the embodiment of FIG. 3 the distance E is slightly less than three times the distance G. According to the equation above N=4, so the printing of the 308 image plane of a document 302 is initiated following a cue delay from the detection of the fourth cue mark downstream of the document. The N cue marks printed before the first document are referred to as leading cue marks.

Figures 5A, 5B, 5C:
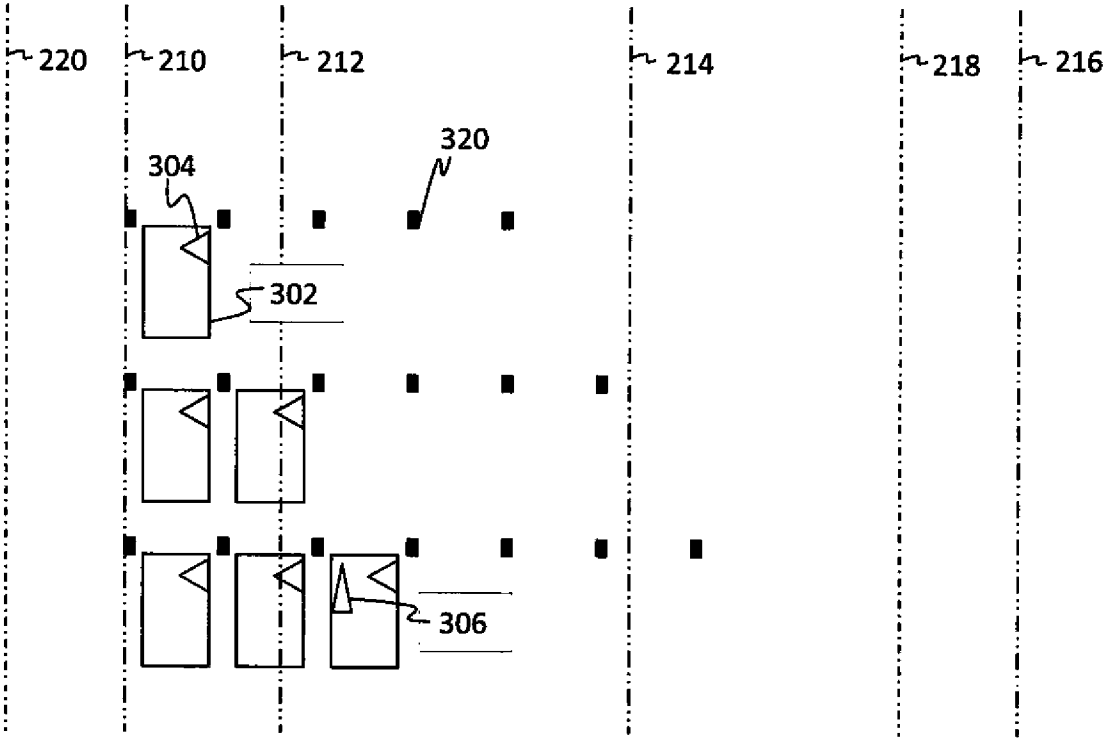
FIGS. 5A-5K illustrates progression of documents as they are printed.
Figures 5D, 5E, 5F, 5G, 5H, 5I, 5J, 5K:
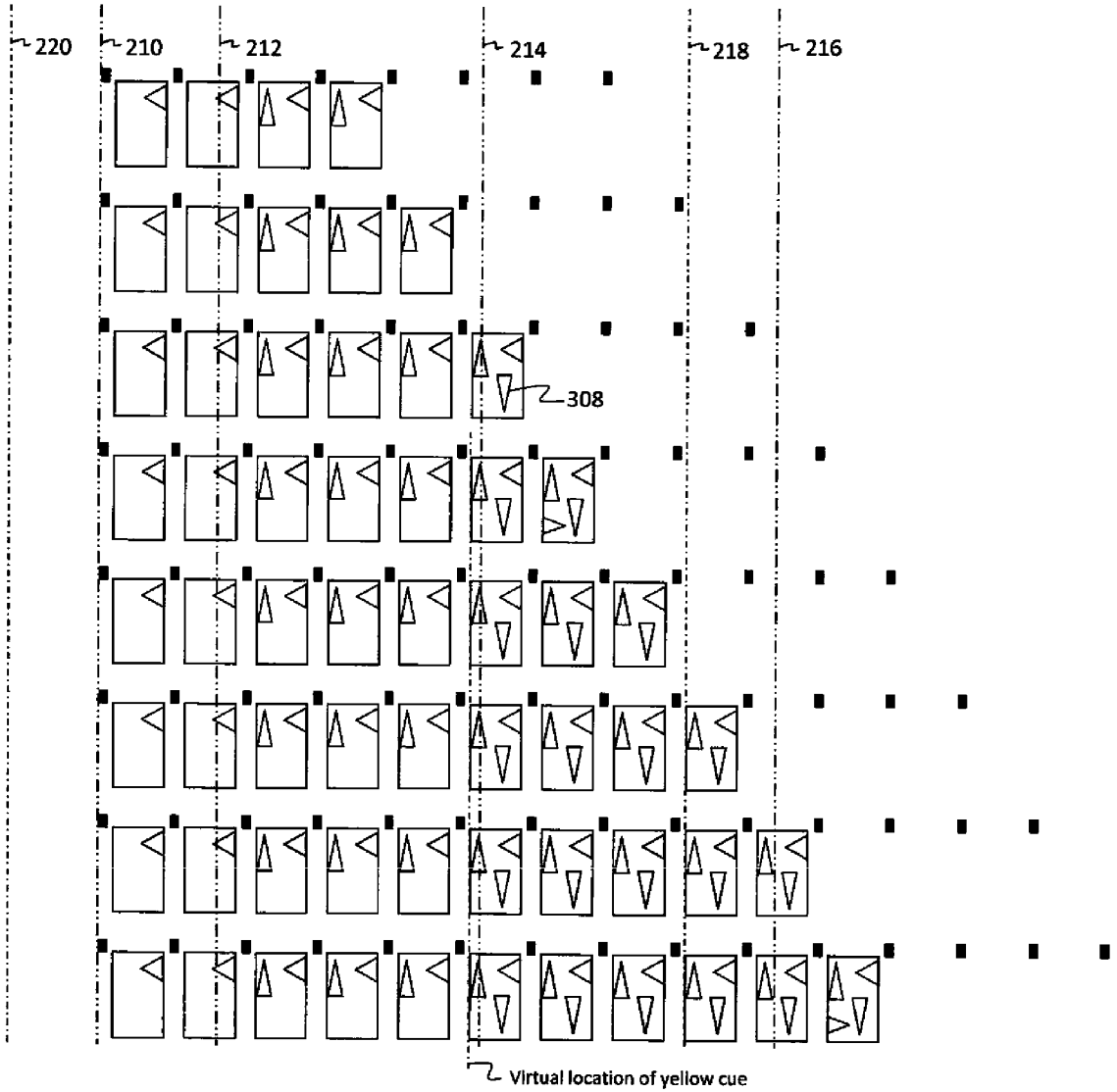

If the cue marks are printed on the print medium 112 by the first linehead 106-1, then the controller or processor 118 (FIG. 1) must direct the first linehead to print N cue marks before initiating the printing of the first image plane 304 of the first document by linehead 106-1, as indicated in FIG. 5A. FIG. 5 shows a progression of documents as they are printed, starting at the printing of a first image plane 304 of a first document is printed by the first linehead 106-1 in FIG. 5A until the fourth image plane 310 of that document is printed by the fourth linehead 106-4 in FIG. 5K. FIG. 5 also includes reference lines 210, 212, 214, 216, and 218, which correspond to the locations of the lineheads 106-1 through 106-4 and of the cue sensor 124. In FIG. 5A, four cue marks 320 are printed before the first image plane 304 of a document 302 is printed. In FIG. 5B, the print medium has continued to move to the right, and the first image plane of another document has been printed as it passes the reference line 210, corresponding to the location of the first linehead 106-1. In FIG. 5C, the first image plane 304 of a third document has been printed as the print medium has continued to move to the right. As the first document (the right most of the documents) passes reference line 212, corresponding to the location of the second linehead 106-2, the second image plane 306 of the document is printed. The printing of second image plane is timed after an appropriate cue delay from the printing of the first image plane.

In FIGS. 5D and 5E, the print medium continues to move the right, and additional cue marks and the first and second image planes of additional documents are printed. In FIG.

5E, the first cue mark has not yet arrived at reference line 218, which corresponds to the location of the cue sensor 124. Once the cue mark arrives at the cue sensor and is detected by the cue sensor 124, the counting encoder pulses for the cue delay of the third plane begins. At the appropriate third image plane cue delay value, the third image plane 308 of the first document is printed by the third linehead 106-3 as the first document passes reference line 214; see FIG. 5F.

Figure 6:
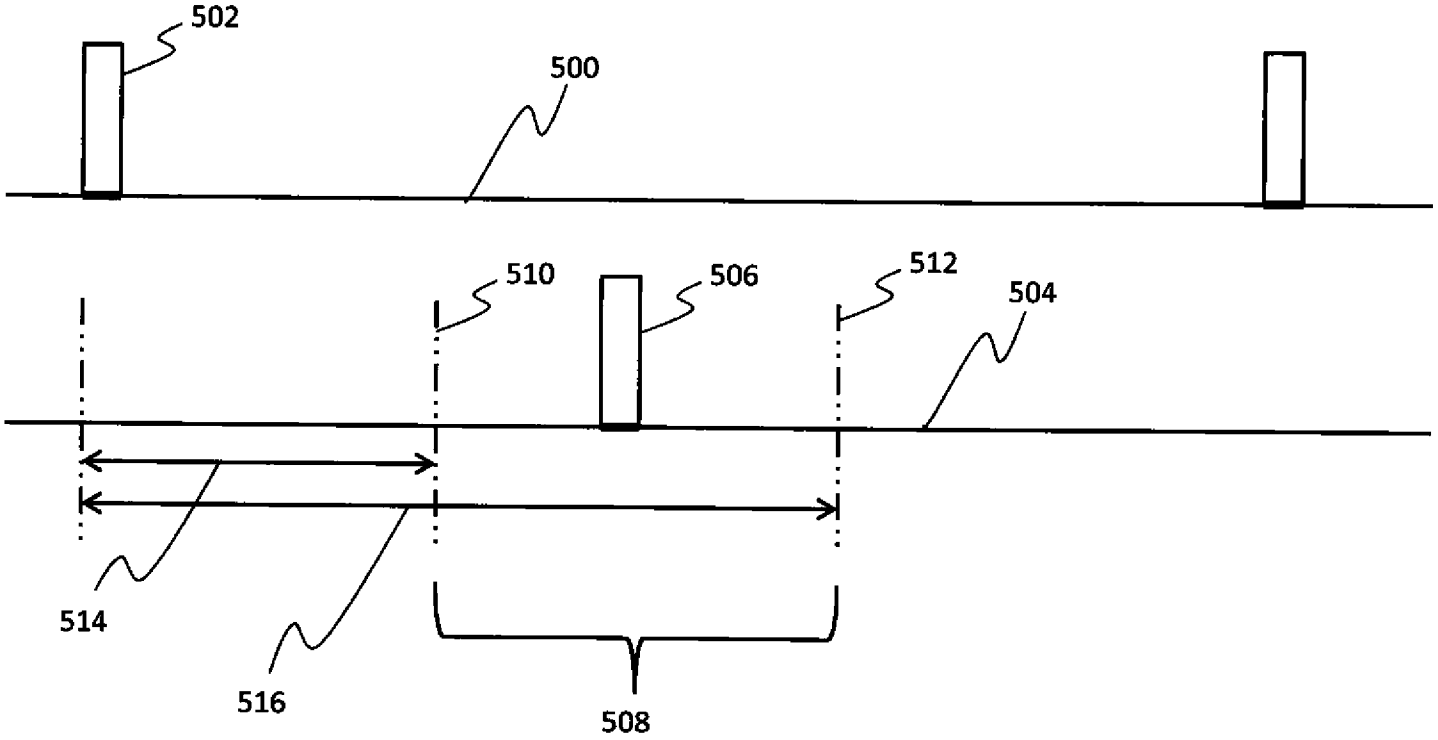
FIG. 6 illustrates a sensing window in an embodiment of the present invention.

The detection of the first cue mark by the cue sensor 124 doesn't initiate a counting encoder pulses for the cue delay of the fourth image plane. The cue sensor must detect the Nth leading cue mark before initiating the counting encoder pulses for the cue delay of the fourth image plane. In FIG. 5J, the Nth leading cue mark (N=4 for this example) has passed the cue sensor corresponding to reference line 218, at which time the cue delay counting begins. After the appropriate fourth image plane cue delay, the fourth image plane 310 is printed by the linehead 106-4 corresponding to reference line 216, as shown in FIG. 5K. As the sequence of figures FIGS. 5A-5K shows, the image plane printed by a linehead upstream of the cue sensor can be properly aligned with the other image planes In some embodiments, the control defines a sensing time window 508 for detection of the cue marks. As indicated in FIG. 6, the leading edge 510 and trailing edge 512 of the sensing time window 508 are defined by a lower and an upper cue delay values 514 and 516, respectively, from the printing of a cue mark by the first linehead, denoted by a cue pulse 502 in signal 500. Only mark detection signals (cue pulses 506 in the signal 504) from the cue sensor 124 received by the controller within the sensing time window 508 are processed as valid cue signals. If the cue sensor were to signal the detection of mark outside of the sensing time window, the controller (FIG. 1) rejects the detection signal as an extraneous noise pulse. In some embodiments having the sensing time window, if an expected cue signal is not received by the controller (FIG. 1) before the trailing edge of the sensing time window, then the controller generates cue signal at the trailing edge of the sensing time window. This ensures that each document will include all of the required image planes. It also helps to ensure that all the image planes stay in the proper correlation to each other, so that a document doesn't get printed with an image plane associated with a different document. In some embodiments having the sensing time window, the controller (FIG. 1) monitors the timing of the cue signal from the cue sensor 124 relative to the leading edge and trailing edge boundaries of the sensing time window. If the controller (FIG. 1) determines that the cue signal is biased toward either the leading or the trailing edge of the sensing time window, then the controller can shift the sensing time window used for future cue signals so that they are more centered in the sensing time window.

Using the process described above, an in-track placement of an image plane printed by a linehead is derived based on the detection of a cue mark using a cue sensor positioned along the media path downstream of the linehead; this downstream cue sensor being referred to a first cue sensor. The in-track position derived in this manner is denoted by X1, and is referred to as a first in-track position. An in-track placement of an image plane printed by the linehead is also derived based on an upstream cue source in some embodiments, which is referred as a second cue sensor. The in-track position derived in this manner is denoted by X2, and is referred to as a second in-track position. The upstream cue source can be an upstream cue sensor, such as upstream cue sensor 126 in FIG. 2. The cue marks detected by this upstream cue sensor can be pre-printed on the print medium by an off-line printing process such as offset printing prior to the print medium being loaded into the digital printing system. Alternatively, the cue marks can be printed by a printing or marking process located upstream of the second cue sensor. The cue marks can be printed marks or detectable marks created by other means such as those described in U.S. Ser. Nos. 13/941,713; 13/941,733; 13/941,768; or 13/941,804, commonly assigned. Upstream cue sensors are commonly used when it is necessary to register the documents or images to be printed with already printed documents or images on the print medium 112.

In other embodiments, the upstream cue source, or second cue sensor, is a virtual cue sensor. The virtual cue sensor corresponds to the first (upstream) linehead that prints the cue marks on the print medium. The cue signals are virtual cue signals, corresponding to signals such as a pulse of a trigger signal used to initiate the printing of a cue mark on the print medium; the trigger signal is referred to as a cue mark triggering signal. The printing of the image plane by the first (upstream) linehead is initiated following an appropriate cue delay from the cue signal that initiates the printing of the cue mark. Typically the signals to trigger the printing of the cue marks originate in the controller (FIG. 1), but since the signals to print the cue mark occur as the cue marks are applied to the print medium 112 by the first linehead 106-1 the timing of the cue mark triggering signals is equivalent to that of signals coming from a cue sensor located at the position of the first linehead 106-1 that detects the cue marks located on the print medium at the spot where the cue marks are being printed by the first linehead. Therefore the effective location of the upstream cue source, the virtual cue sensor, is the location of the first linehead. The controller typically determines the timing between the cue mark triggering signals from an encoder count value corresponding to the length of the documents.

In embodiments that derive the in-track positions for image planes printed by a linehead based on the detection of cue marks by the downstream cue sensor and also based on an upstream cue source, the controller 118 (FIG. 1) can evaluate both the derived first and second in-track positions X1 and X2 to determine the in-track placement of the image planes printed by the linehead by an interpolation process. In some embodiments, the interpolation process comprises a determination of the midpoint between the first and second in-track positions X1 and X2. In other embodiments, the controller 118 (FIG. 1) uses the values for the distance between the upstream cue source and the linehead and the distance between the linehead and the downstream cue sensor in the interpolation, in a way that weights the result by the relative spacings; since the spacing between the yellow linehead 106-3 to the downstream encoder 124 is significantly less than the spacing of the yellow linehead 106-3 to the first linehead 106-1, the interpolation biases the determined in-track position closer to the first in-track position X1 than to the second in-track position X2. In another embodiment, the controller 118 (FIG. 1) evaluates the ink coverage levels applied to the portion of the print medium 112 between the first linehead 106-1 and linehead 106-3, which affect the stretch of that portion of the print medium, and the ink coverage levels applied to the portion of the print medium between linehead 106-3 and the cue sensor 124, which affects the stretch of the corresponding portion of the print medium. Significant imbalances in the ink coverage levels in these portions of the print medium can change the relative amounts of medium stretch in the two portions of the print medium. The interpolation performed by the processor 118 (FIG. 1) can shift the in-track position away from the midpoint between the derived first and second in-track positions X1 and X2 toward either the first or the second position based on the ink coverage levels to account for ink coverage induced stretch variations upstream and downstream of the linehead 106-3.

In some embodiments, the quality control sensor captures images of the registration marks associated with each image plane. From the relative position of the registration marks of each image plane an image quality processor, which may be included in the processor 118 (FIG. 1), determines registration corrections that can be applied to each image plane. The analysis of the registration of the third image plane 308 to the other image planes, can include identifying, based on the measured placement of the third image plane, the derived first and second in-track positions X1 and X2, and information as to where the third image plane was printed relative to the derived first and second in-track positions, which of the derived in-track positions would produce smaller registration errors. Based on this determination, the controller can select the identified one of the first and second in-track positions for future use in registering the third image plane.

Figure 7:
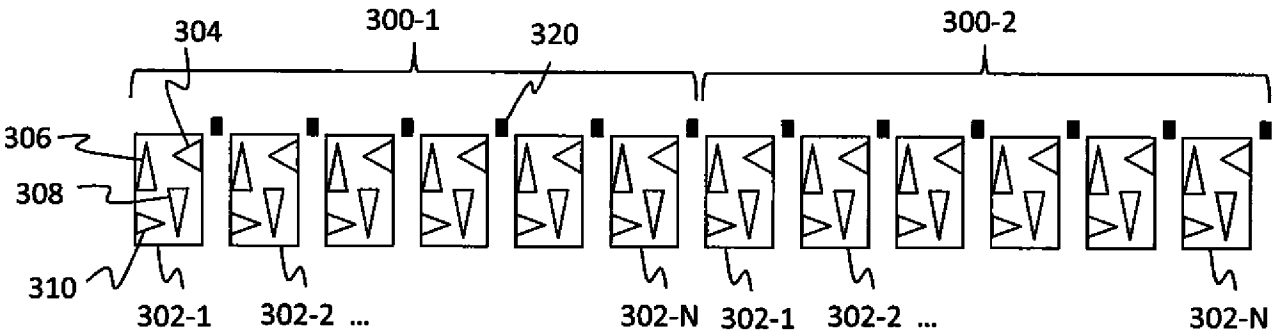
FIG. 7 illustrates printing multiple copies of a print job.

Referring now to FIG. 7, there is shown one example of printing multiple copies of a print job 300 including a number of documents 302 to be printed in sequential order; a first copy of the print job labeled 300-1 and a second copy labeled 300-2. As used herein, the term "print job" refers to information to be printed more than once, the print job 300 includes one or more documents, and the content in the information is substantially the same each time a copy of the information or a document is printed. The information to be printed can have some variations. For example, a report that is sent to multiple recipients can vary the name and address of the recipient in each printing of the report while maintaining the consistency of the rest of the information to be printed. Examples of such information include, but are not limited to, books, magazines, reports, and transactions.

The print job includes a sequence of N number of documents, where N is equal to or greater than one. In the illustrated aspect, the print job 300 includes N documents 302-1 to 302-N. Across the width of the print media, each document can include more than multiple pages, FIG. 6 however shows each document as a single page. Each document includes one or more image planes. FIG. 7 shows four image planes 304, 306, 308, and 310, which are sequentially printed on the print media as the print media progresses past the linehead that prints the corresponding image plane.

A print job can have one document positioned across the width of the print medium in an aspect of the invention. The print job depicted in FIG. 7 illustrates one document positioned across the width on the print medium. In other aspects, a print job can have multiple documents positioned across the width of the print medium. A document can include any printed output such as, for example, text, graphics, or photos, individually or in various combinations. The printed output can be disposed anywhere on the print medium, and the printed output in each document can differ from the printed content in the other documents in a print job.

The color registration errors can repeat each time a copy of the sequence of documents in a print job is printed. Moreover, the repeating color registration errors can be specific to each document in the print job, and more specifically to particular regions within the individual documents. For example, in a print job having a sequence of three documents which are repeatedly printed in sequential order, the color registration errors in the second document can repeat each time the second document is printed. The color registration errors for the third document can be different from the color registration errors for the second document. And the color registration errors in the third document can repeat each time the third document is printed. Furthermore within the second document, there can be regions of the document which exhibit one level of particular type of registration error that is consistently different than the corresponding registration error in a different region in the same document for each copy of the second document that is printed.

Recognizing the repeatability of the registration errors, an embodiment of the invention varies the interpolation between the derived X1 and the X2 in-track positions for the third image plane from one document to the next document within a copy of the print job based on the registration errors measured during the printing of previous copies of the print job for the corresponding documents in the print job.

The invention has been described in detail with particular reference to certain preferred embodiments thereof, but it will be understood that variations and modifications can be effected within the spirit and scope of the invention

PARTS LIST

100 printing system
102 first tower
104 second tower
106 linehead
106-1 linehead
106-2 linehead
106-3 linehead
106-4 linehead
108 dryer
110 quality control sensor
112 print medium
114 transport direction
116 turnover module
118 processor
120 storage device
122 encoder
124 cue sensor
126 cue sensor
200 printhead
202 nozzle array
204 support structure
210 reference line
212 reference line
214 reference line
216 reference line
218 reference line
220 reference line
300 print job
300-1 first copy
300-2 second copy
302 documents
304 first image plane
306 second image plane
308 third image plane
310 fourth image plane
400 reference color plane
402 color plane
404 in-track direction
406 cross-track direction
500 signal
502 cue mark

504 signal
506 cue pulse
508 sensing time window
510 leading edge
512 trailing edge
514 lower cue-delay value
516 upper cue-delay value
E distance
F distance
G spacings

The invention claimed is:

1. A method for printing a plurality of documents each having a plurality of image planes on a substrate, the method comprising:

(a) providing a plurality of print heads for depositing material on the substrate as the substrate moves along a transport path, each printhead printing an associated image plane and being located at an associated position along the transport path;

(b) providing a first sensor in a predetermined position along a transport path downstream relative to predetermined positions of the plurality of print heads;

(c) providing an indication of position of the substrate along the transport path;

(d) providing a plurality of cue marks at predetermined positions or intervals on the substrate, each cue mark being detected by the first sensor as the cue mark moves along the transport path past the first sensor;

(e) for each document initiating the printing of an image plane printed by one of the plurality of print heads located along the transport path upstream of the first sensor following an appropriate pre-defined cue delay from the detection of one of the plurality of cue marks on the substrate by the first sensor.

2. The method as in claim 1, wherein providing the plurality of cue marks includes printing one or more leading cue marks sufficient to span a distance between the first sensor and the at least one upstream print head.

3. The method as in claim 2, wherein the indication of position is provided by an encoder for determining position of the substrate.

4. The method as in claim 1, wherein the indication of position is provided by an encoder for determining position of the substrate.

5. The method as in claim 1 further comprising providing a second sensor upstream of the at least one print head for producing second cue signals that correspond to the detection of the cue marks at the second sensor.

6. The method as in claim 5, wherein initiating printing of the image plane of the document is adjusted based on a determination of a deviation between the image plane position based on the pre-defined cue delay and the detection of the position of the cue marks on the substrate by the first sensor and a second image plane position based on a different pre-defined cue delay and cue signals of the second sensor.

7. The method as in claim 6, wherein the adjustment based on the deviation of image plane position is determined by interpolation.

8. The method as in claim 6, wherein interpolation is determined by relative distance between each of the two cue sensors and the print head that prints the image plane.

9. The method as in claim 6, wherein interpolation is determined by image content between each of the two cue sensors and the print head that prints the image plane.

10. The method of claim 6, wherein the printing a plurality of image planes on a substrate comprises the printing of multiple copies of a sequence of documents; and wherein the interpolation varies from one document to the next document within a copy of the sequence of documents based on the registration errors measured during the printing of a previous copy of the sequence of documents for the corresponding documents in the sequence of documents.

11. The method as in claim 1 further comprising a system for measuring registration of the image planes printed by the plurality of print heads.

12. The method of claim 1, wherein the one of the plurality of print heads is located along the transport path downstream of the first sensor, and for each document the initiating of the printing of an image plane by the downstream print head following a second pre-defined cue delay from the detection of a cue mark by the first sensor.

13. The method claim 12, wherein following the detection of a cue mark by the first sensor, the image plane printed by the print head upstream of the first sensor and the image plane printed by the print head downstream of the first sensor are image planes of different documents.

* * * * *